United States Patent [19]

Kastelic

[11] Patent Number: 4,494,348

[45] Date of Patent: Jan. 22, 1985

[54] PRE-ENGINEERED MODULAR BUILDING PANEL ASSEMBLY

[76] Inventor: Rudolph F. Kastelic, 15436 Wenhaven, Chagrin Falls, Ohio 44022

[21] Appl. No.: 331,086

[22] Filed: Dec. 15, 1981

[51] Int. Cl.[3] ..... E04C 1/10

[52] U.S. Cl. ..... 52/588; 52/404; 52/462; 52/809

[58] Field of Search ..... 53/588, 404–408, 53/410, 419, 459, 462–467, 809, 811, 460, 461, 468–472

[56] References Cited

U.S. PATENT DOCUMENTS

| | | | |
|---|---|---|---|
| 1,524,090 | 1/1925 | Finley | 52/459 |
| 2,039,293 | 5/1936 | Calkins | 52/404 |
| 2,263,201 | 11/1941 | Wheeler et al. | 52/404 |
| 2,271,575 | 2/1942 | Waterman | 52/406 |
| 2,578,599 | 12/1951 | Rose | 52/404 |
| 2,747,703 | 5/1956 | Broberg . | |
| 2,836,266 | 5/1958 | Leeser . | |
| 2,927,665 | 3/1960 | Hauf . | |
| 3,062,337 | 11/1962 | Zittle | 52/404 |
| 3,290,845 | 12/1966 | Snyder | 52/588 |
| 3,320,707 | 5/1967 | Berg . | |
| 3,333,383 | 8/1967 | Raudebaugh | 52/588 |
| 3,399,503 | 9/1968 | Payne | 52/588 |
| 3,514,915 | 6/1970 | Johnson . | |
| 3,729,879 | 5/1973 | Franklin | 52/406 |
| 3,935,688 | 2/1976 | Trojahn et al. . | |
| 3,998,024 | 12/1976 | Frandsen . | |
| 4,104,840 | 8/1978 | Heintz et al. . | |
| 4,107,891 | 8/1978 | Cotton, Jr. et al. . | |
| 4,107,892 | 8/1978 | Bellem . | |
| 4,117,638 | 10/1978 | Kidd, Jr. et al. . | |
| 4,120,123 | 10/1978 | Knudson | 52/588 |
| 4,129,973 | 12/1978 | Keller . | |
| 4,138,808 | 2/1979 | Walkiewicz | 52/588 |
| 4,177,615 | 12/1979 | Anderson . | |
| 4,393,859 | 7/1983 | Marossy | 52/588 |

FOREIGN PATENT DOCUMENTS

| | | | |
|---|---|---|---|
| 2709976 | 3/1977 | Fed. Rep. of Germany | 52/409 |

*Primary Examiner*—Henry E. Raduazo

*Attorney, Agent, or Firm*—Fay & Sharpe

[57] ABSTRACT

A panel assembly is provided particularly adapted for a pre-engineered insulated modular panel assembly. The panel assembly is comprised of a plurality of panel sets with each set including a plurality of rigid panel members. Each panel member has a panel wall with first and second longitudinal edge flanges configured for overlapping and mating reception with the edge flanges of an adjacent panel member to define panel joints. The first and second edge flanges have end portions disposed remote from the panel wall to define a panel cavity. Each panel set further includes a first end panel joint, a second end panel joint and at least one intermediate panel joint. An insulating core is provided comprising a plurality of insulating core sets with each set including an insulating body and a moisture barrier skin received in the panel cavity and about the panel joints. Each insulating core set is sized to span one of the panel sets. The insulating body includes intermediate longitudinal slots for receiving intermediate panel joints of the panel sets. Means are provided for fastening the edge flanges and the insulating core.

12 Claims, 4 Drawing Figures

PRE-ENGINEERED MODULAR BUILDING PANEL ASSEMBLY

BACKGROUND OF THE INVENTION

This invention pertains to the art of modular building panel assemblies and more particularly to panel assemblies including wall insulation.

The invention is particularily applicable to a pre-engineered modular building panel assembly including a plurality of pre-fabricated modular panels wherein each panel includes a rigid outer panel wall with opposed edge flanges for nesting interconnection and an insulating core with a moisture barrier skin. However, it will be appreciated by those skilled in the art that the invention could be readily adapted for other uses, as, for example, where similar panel assemblies are employed.

Conventional modular building panel assemblies which include an insulating core have typically comprised a rigid outer panel wall, an inner panel wall spaced from the outer wall to define a panel cavity, insulation batts received in the cavity and various types of seals between adjacent panel members. Typically, the seals comprise mating flanges disposed along the vertical edges of the panel members in combination with elastomeric or deformable plastic materials for fluid sealing engagement between the flanges. A vapor barrier is advantageous in such a system to avoid the problems of moisture forming on the interior of the inner panel walls when the building temperature varies substantially from the ambient temperature.

The various forms and types of modular panel assemblies which have heretofore been suggested and employed in the building industry have met with varying degrees of success. It has been found that the defects present in most prior pre-engineered modular building panel assemblies are such that the assemblies themselves are of limited economic and practical value.

A common problem with respect to prior art systems of this type is that they do not provide a simple and inexpensive means to establish a vapor barrier. Typically, a complicated seal is employed which requires specially configured interlocking flanges in combination with pliable plastic materials that are both expensive to make and assemble.

An added existing problem has been that previous insulating batts received in the panel wall cavities have been made in single panel widths which increases the time required for installation. Moreover, the depth of the flanges provided on the panel members has typically defined the depth of the panel cavity available for insulation. Such depth has inherently limited the thickness of insulation which can be employed with the systems.

The present invention contemplates a new and improved pre-engineered modular building assembly which overcomes all the above referred to problems and others to provide a new building panel assembly which is simple in design, economical to manufacture, readily adaptable to a plurality of uses with panel members having a variety of dimensional characteristics, and which provides improved insulation from weather and environmental hazards.

A BRIEF SUMMARY OF THE INVENTION

In accordance with the present invention, there is provided a panel assembly comprising a plurality of panel sets with each such set including a plurality of rigid panel members. The panel members each have a panel wall and first and second longitudinal edge flanges configured for overlapping and mating reception to define a panel joint between the edge flanges of an adjacent second panel member. The first and second edge flanges have end portions disposed remote from the panel wall to define the panel cavity. Each panel set further includes a first end panel joint, a second end panel joint and at least one intermediate panel joint. An insulating core is provided comprising a plurality of insulating core sets. Each core set includes an insulating body and a moisture barrier skin received in the panel cavity and about the panel joints and is sized to span one of the panel sets. The insulating body includes intermediate longitudinal slots for receiving intermediate panel joints of the panel sets. Means are provided for fastening the edge flanges and the insulating core.

In accordance with another aspect of the present invention, the moisture barrier skin of the insulating core sets includes terminal edge portions that extend laterally beyond the body for adhesive engagement to the panel joints.

According to a further aspect of the invention, the insulating body extends from the panel wall beyond the end portions of the edge flanges. The intermediate longitudinal slots are sized for close reception of the panel joints and include a slot depth less than a depth of the insulating body.

In accordance with a more limited aspect of the invention, the insulating core is secured to the panel sets with a trim strip fastened to the end portions of the edge flanges. The moisture barrier skin is fastened intermediate the trim strip and the end portions.

Also according to the invention, there is provided an end joint between adjacent first and second panel sets of a panel assembly comprising a first end flange of the first panel set disposed in nesting engagement to a second end flange of a second panel set. A first moisture barrier skin of the first panel set sealingly engages the second end flange of the second panel set and a second moisture barrier skin of the second panel set sealingly engages the first moisture barrier skin. Means are provided for fastening the first and second moisture barrier skins to the first and second end flanges.

In accordance with a further aspect of the present invention, the first and second end flanges depend inwardly from an outer panel wall of the first and second panel sets and include end portions disposed in parallel-planar alignment to the panel wall In accordance with a further aspect of the invention, the first moisture barrier skin overlies the end portions of the end flanges and is adhesively engaged to a side wall portion of the second end flange. The second moisture barrier skin is adhesively engaged to the first moisture barrier skin opposite the end portions of the end flanges.

One benefit obtained by use of the present invention is a pre-engineered modular building panel assembly which provides a simple and inexpensive means to establish a vapor barrier.

Another benefit obtained from the invention is a modular building panel assembly which provides an insulating core including insulating batts which span more than a single panel for reducing the time required for installation.

A further benefit of the present invention is a building panel assembly which provides an insulating core that is not limited to the thickness of the interconnecting end flanges of a panel.

Other benefits and advantages for the subject new pre-engineered modular building panel assembly will become apparent to those skilled in the art upon a reading and understanding of this specification.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

DETAILED DESCRIPTION OF THE INVENTION

Figure 2:
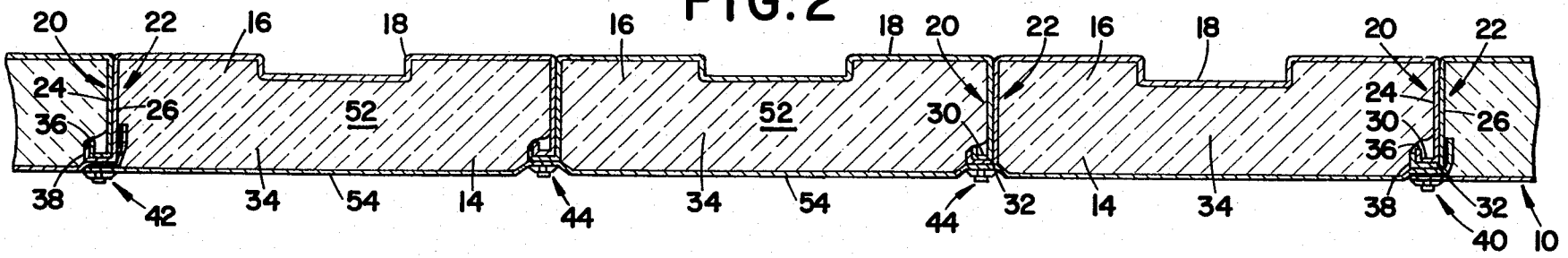
FIG. 2 a cross-sectional view taken along line 2—2 of FIG. 1.
Figure 1:
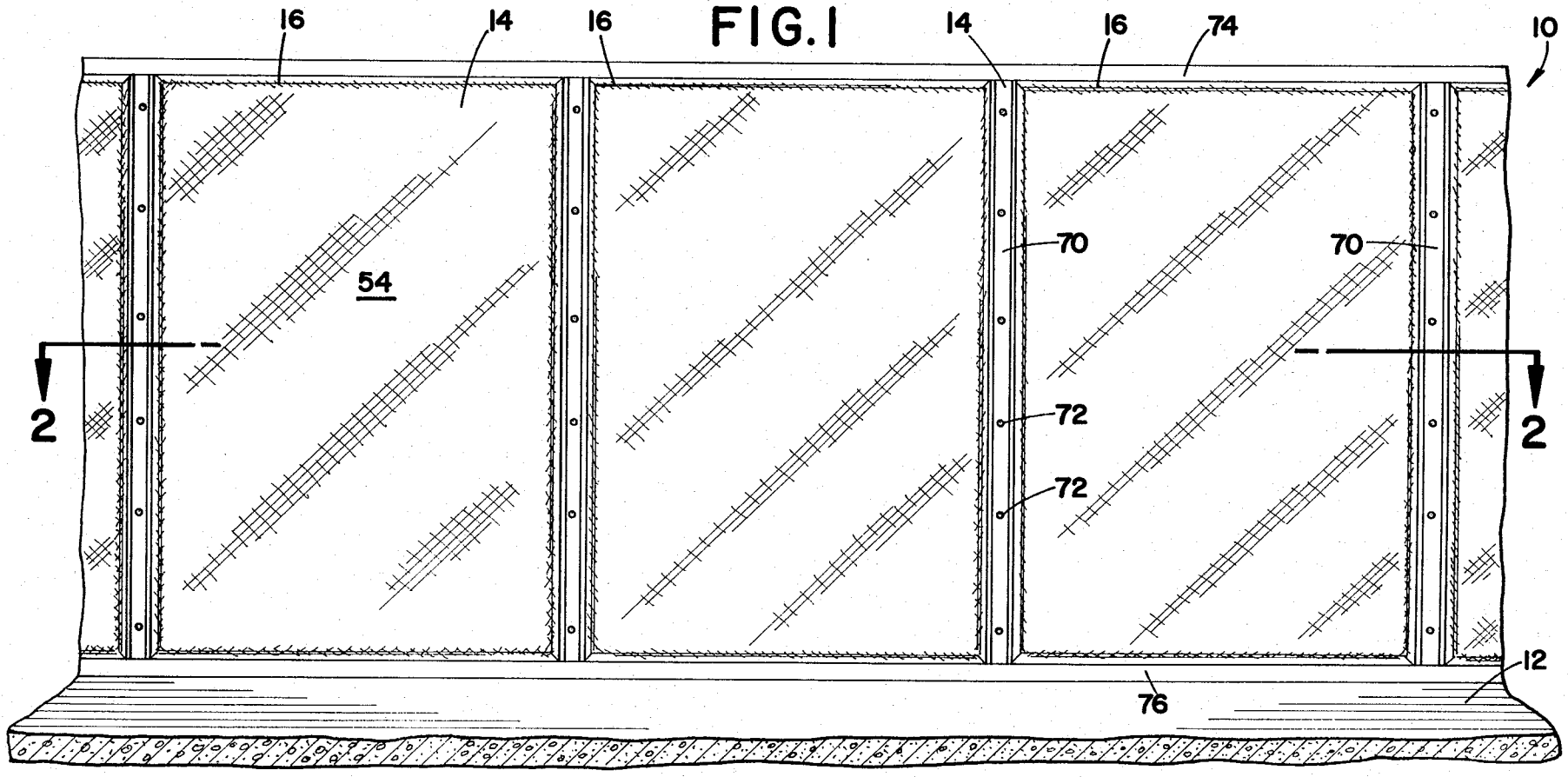
FIG. 1 a side elevational view of a section of a building panel assembly formed in accordance with the present invention.

Referring now to the drawings where the FIGURES are for purposes of illustrating a preferred embodiment of the invention only and not for purposes of limiting same. FIGS. 1 and 2 show a pre-engineered modular building panel assembly 10 configured for use as an upright side wall of a building and adapted for mounting or resting upon a building floor 12.

More specifically panel assembly 10 is comprised of a plurality of panel sets 14, each set including a plurality of panel members 16. Each of the panel members 16 includes a rigid panel outer wall 18 preferably constructed of corrugated steel for strength and durability. A first longitudinal edge flange 20 and a second longitudinal edge flange 22 depend normally from and are laterally spaced apart along opposite edges of the panel outer wall 18. The edge flanges extend inwardly from the panel outer wall 18 and are configured for overlapping and mating reception to define a panel joint between the first edge flange of a first panel member and the second edge flange of an adjacent second panel member The edge flanges 20,22 include end portions 30,32 disposed remote from the panel wall 18 to define a panel cavity 34 of panel member 16. The edge flanges include side wall portions 24,26, respectively depending normally and inwardly from the panel member outer wall 18. The edge flange end portions 30,32 are preferably disposed in parallel-planar alignment to the panel outer wall 18 and include terminal end lips 36,38. End portions 30, 32 and lips 36, 38 are sized such that first edge flange 20 is closely received in second edge flange 22 for nesting engagement to inhibit lateral or flexible movement between them.

In the preferred embodiment of the invention, each panel set 14 includes three panel members 16, although it is within the scope of the invention to include any other number of panel members within a panel set. Each panel set 14 includes a first end panel joint generally designated as 40 (FIG. 2), a second end panel joint generally designated as 42 and two intermediate panel joints generally designated 44. Each of the panel joints 40, 42, 44 are identical insofar as they comprise interconnecting panel member edge flanges; however, they do differ in relation to the panel assembly inner wall and insulating core as will hereinafter be more fully explained.

Figure 4:
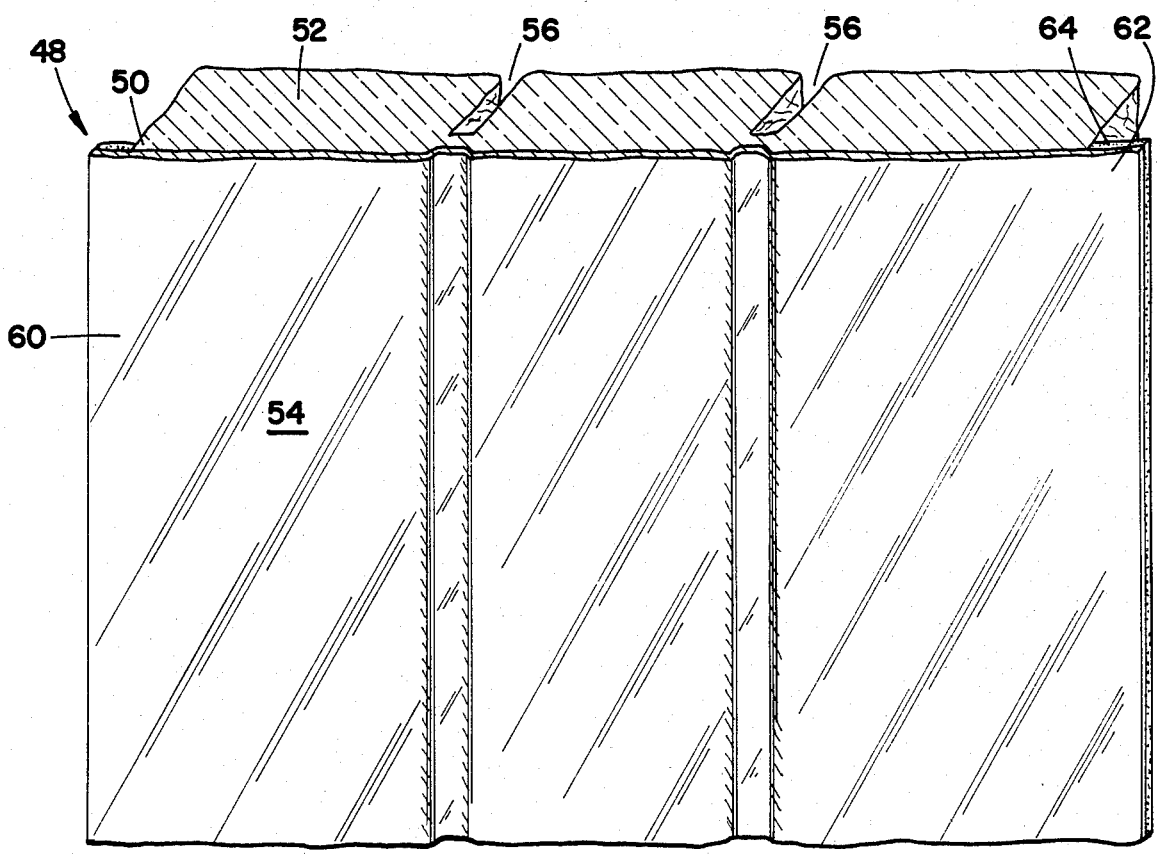

With particular reference to FIGS. 2 and 4, the panel assembly 10 includes an insulating core 48 comprising a plurality of insulating core sets 50 with each core set being sized to span a panel set 14. Each set 50 includes an insulating body 52 and a moisture barrier skin 54. insulating body 52 is received in panel cavities 34 and includes intermediate longitudinal slots 56 for receiving the intermediate panel joints 44. It is a particular feature of the invention that the longitudinal slots 56 are sized for close and overlying reception of the intermediate panel joints 44 and include a slot depth less than the depth of the insulating body 52, thereby providing an insulating core over-all depth greater than the inward extent of the edge flanges 20,22. The insulating body 52 extends from the panel outer wall 18 to the moisture barrier skin 54 and may be constructed of various conventional insulating materials such as glass fiber strands or the like.

Moisture barrier skin 54 provides a panel inner or back wall and preferably comprises a vinyl sheeting material which functions as a moisture seal or vapor barrier. Terminal edge portions 60, 62 of the skin extend laterally beyond the insulating body 52 for adhesive engagement to the panel set end joints 40,42.

Figure 3:
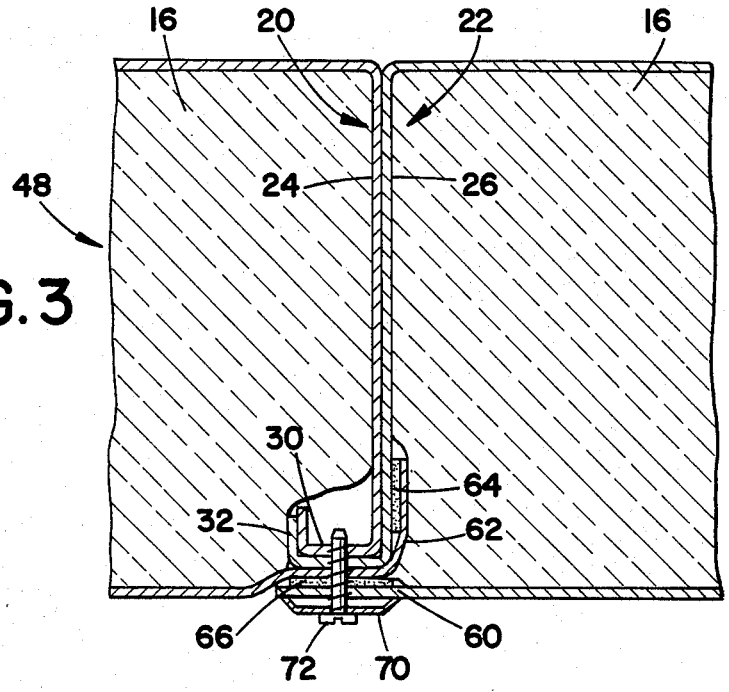
FIG. 3 an enlarged cross-sectional view particularly showing an end joint of a panel set formed in accordance with the present invention; and, FIG. 4 is a generally perspective view of an insulating core set for a panel set of a panel assembly formed in accordance with the present invention.

With particular attention to FIG. 3 a panel set end joint is more fully illustrated. The panel members 16 are interconnected in nesting engagement at the edge flanges 20,22 and the insulating core 48 is installed into the panel cavities 34 by merely packing the insulating core over the panel joints for abuttment to the panel outer wall 18. A skin terminal edge portion 62 of a first panel set is sized to overlie the edge flange end portions 30,32 and is adhesively attached to the side wall 26 of the edge flange 22 of an adjacent panel set. It is within the scope of the invention to employ a variety of means for attaching the skin terminal edge portion 60 to the edge flange 22 including a variety of pliable sealants or tapes; however, a double-faced adhesive tape 64 is advantageously employed in the preferred embodiment. The skin terminal edge portion 60 of the moisture barrier skin 54 of an adjacent panel set is sized to overlap the edge flange end portions 30,32 and to be adhesively attached to the outer surface of the skin terminal edge portion 62 opposite of the edge flange end portions 30,32. A double faced adhesive tape 66 is likewise advantageously employed for this purpose. The present system thus provides a simple and inexpensive means to establish a vapor barrier seal between adjacent panel sets.

As best shown in FIG. 1, the moisture barrier skin 54 is further fastened to the edge flanges 20,22 with a trim strip 70 and threaded fasteners 72. The trim strip is preferably a rigid member, longitudinally co-extensive with the edge flanges 20,22 and which operates to compact the skin terminal edge portions 60,62 for improved sealing. The threaded fasteners 72 are advanced through the trim strip 70, the interposed skin portions 60, 62, the tape 66 and the edge flange end portions 30,32 (FIG. 3) to further secure the panel joints and the vapor barrier seal.

The trim strip 70 and threaded fasterners 72 are likewise employed at intermediate panel joints 44 and operate to compact the moisture barrier skin 54 and portion of insulating body opposite of the edge flange end portions 30,32. The insulating body intermediate of the panel joints is not compacted and the panel inner wall 54 and insulating core 48 advantageously extend inwardly beyond the flange end portions 30,32 and into a room enclosed by panel assembly 10 to provide a greater amount of insulating material and to present a puffed appearance. The top and bottom edges of insulating core 48 are further secured in a conventional manner with tack strips 74,76.

The invention has been described with reference to the preferred embodidment. Obviously, modifications and alterations will occur upon the reading and understanding of the specification. It is my intention to include all such modifications and alterations in so far as they come within the scope of the independent claims or the equivalents thereof.

Having thus described the invention, I now claim:

1. A panel assembly comprising:

a plurality of panel sets including a plurality of rigid panel members, each panel member having a panel wall and first and second longitudinal edge flanges configured for overlapping and mating reception to define a panel joint with one of the second and first edge flanges respectively of an adjacent second panel member, said first and second edge flanges having end portions disposed remote from said panel wall to define a panel cavity, each panel set further including a first end panel joint, a second end panel joint and at least one intermediate panel joint;

an insulating core comprising a plurality of insulating core sets with each core set including an insulating body and a moisture barrier skin received in said panel cavity and about said panel joints and being sized to span one of said panel sets, said insulating body including intermediate longitudinal slots for receiving intermediate panel joints of said one panel set; and, means for fastening said edge flanges and said insulating core.

2. The panel assembly as defined in claim 1 wherein said moisture barrier skin of said insulating core sets extends laterally beyond said body for attachment to said panel joints.

3. The panel assembly as defined in claim 2 wherein said mositure barrier skin includes terminal edge portions adhesively attached to said first and second end panel joints.

4. The panel assembly as defined in claim 3 wherein the moisture barrier skin terminal edge portions of a first panel set overlap and are adhesively attached to the moisture barrier skin terminal edge portions of adjacent panel sets.

5. The panel assembly as defined in claim 3 wherein said terminal edge portions are adhesively attached with double-faced adhesive tape.

6. The panel assembly as defined in claim 1 wherein said insulating body extends from said panel wall beyond said first and second edge flange end portions.

7. The panel assembly as defined in claim 6 wherein said intermediate longitudinal slots are sized for close reception of said panel joints and include a slot depth less than a depth of said insulating body.

8. The panel assembly as defined in claim 1 wherein said insulating core is secured to said panel sets with a trim strip secured to said end portions of said first and second edge flanges.

9. The panel assembly as defined in claim 8 wherein said moisture barrier skin is secured intermediate of said trim strip and said end portions.

10. An intermediate joint of a panel set for a panel assembly comprising:

a first edge flange of a first panel member in said panel set disposed in nesting engagement with a second edge flange of a second panel member in said panel set, an insulating core of said panel set comprising an insulating body and a moisture barrier skin and including a longitudinal slot for receiving and overlying said first and second edge flanges and, means for securing said insulating core and said first and second edge flanges.

11. The intermediate joint as defined in claim 10 wherein said edge flanges each comprise a flange side wall depending from an outer panel wall of the associated panel member and a flange end portion disposed in parallel-planar alignment with said panel wall.

12. The intermediate joint as defined in claim 10 wherein said securing comprises a rigid member affixed to said first and second edge flanges, said insulating core being interposed between said rigid member and said edge flanges.

* * * * *